US005950600A

United States Patent [19]

Ricco

[11] Patent Number: 5,950,600

[45] Date of Patent: Sep. 14, 1999

[54] DEVICE FOR CONTROLLING AN INTERNAL COMBUSTION ENGINE FUEL INJECTOR

[75] Inventor: Mario Ricco, Bari, Italy

[73] Assignee: Elasis Sistema Ricerca Fiat Nel Mezzogiorno Societa Consortile Per Azioni, Pomigliano D'Arco, Italy

[21] Appl. No.: 09/190,305

[22] Filed: Nov. 12, 1998

[30] Foreign Application Priority Data

Nov. 18, 1997 [IT] Italy ..... TO97A1006

[51] Int. Cl.[6] ..... F02M 41/00

[52] U.S. Cl. ..... 123/467; 123/446

[58] Field of Search ..... 123/467, 446, 123/447, 500, 501, 506; 239/88–95

[56] References Cited

U.S. PATENT DOCUMENTS

| | | | |
|---|---|---|---|
| 3,810,453 | 5/1974 | Wolfe | 123/467 |
| 4,603,671 | 8/1986 | Yoshinaga | 123/467 |
| 4,798,186 | 1/1989 | Ganser | 123/467 |
| 5,176,120 | 1/1993 | Takahashi | 123/467 |
| 5,186,151 | 2/1993 | Schwerdt | 123/467 |
| 5,419,492 | 5/1995 | Gant | 239/94 |
| 5,522,545 | 6/1996 | Camplin | 239/92 |
| 5,526,991 | 6/1996 | Timmer | 123/467 |
| 5,671,715 | 9/1997 | Tsuzuki | 123/467 |
| 5,711,279 | 1/1998 | Green | 123/467 |
| 5,862,793 | 1/1999 | Jay | 123/467 |

FOREIGN PATENT DOCUMENTS 0548916 6/1993 European Pat. Off. .

*Primary Examiner*—Carl S. Miller
*Attorney, Agent, or Firm*—Ladas & Parry

[57] ABSTRACT

The injector has a hollow body supporting a nozzle, and a metering valve having a valve body housed in a cylindrical seat in the hollow body; the valve body has a guide seat for a rod controlling the pin of the nozzle; the guide seat terminates with an end surface against which a stop portion of the rod is arrested; the stop portion has a truncated-cone-shaped surface which engages a truncated-cone-shaped portion of the end surface of the guide seat; and the truncated-cone-shaped portion is adjacent to the control chamber and has the same taper as the truncated-cone-shaped surface.

4 Claims, 1 Drawing Sheet

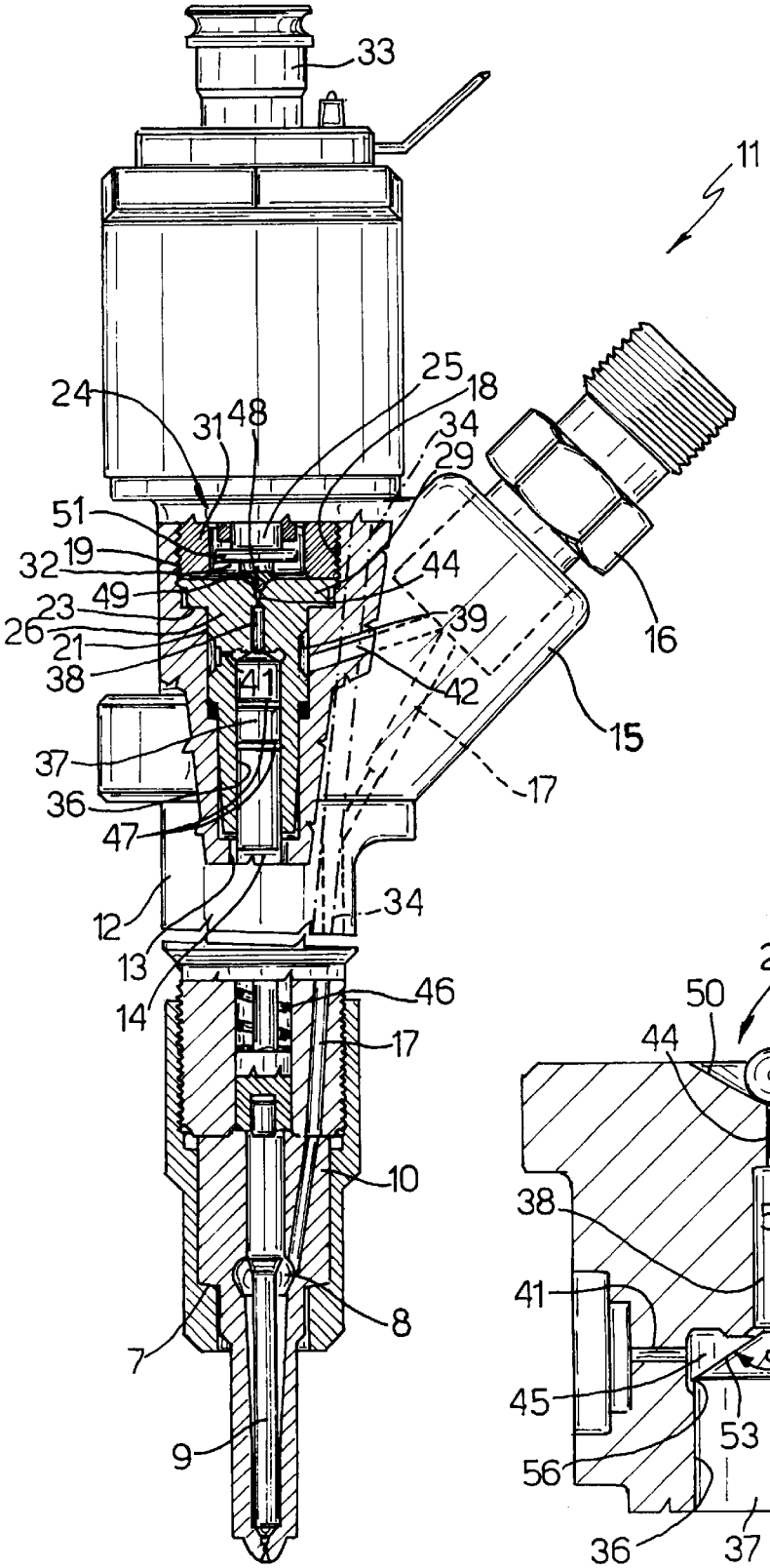
Fig. 1
Fig. 2
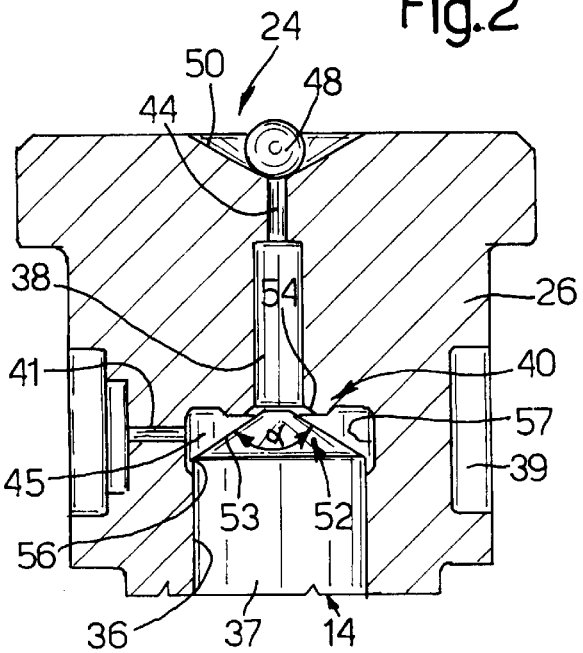

DEVICE FOR CONTROLLING AN INTERNAL COMBUSTION ENGINE FUEL INJECTOR

BACKGROUND OF THE INVENTION

The present invention relates to a device for controlling an internal combustion engine fuel injector.

Known injectors normally comprise a nozzle control rod controlled hydraulically by a metering valve, which comprises a valve body having a rod guide seat coaxial with a control chamber supplied with pressurized fuel. The control chamber communicates with a discharge chamber via a discharge conduit normally closed by a shutter controlled by an electromagnet.

To close the control chamber temporarily when the metering valve is opened, the control rod normally comprises a portion which is arrested against a flat end surface of the guide seat in the valve body; and, to reduce fuel flow when the metering valve is open, the lateral surface of the control rod, positioned closing the control chamber, normally partially closes the pressurized fuel inlet conduit adjacent to the flat surface of the rod guide seat.

A major drawback of known injectors of the above type is the considerable axial rebound of the rod on impact with the flat surface of the valve body, so that fuel flows into the control chamber, thus resulting in forced oscillation of the rod about the hydraulic balance position, and in irregular fuel supply by the injector, which calls for fluctuating opening and closing times of the nozzle by the central control unit.

To reduce such oscillation, injectors have been proposed in which the surface arresting the rod is provided with micrometric grooves to prevent closing the control chamber entirely as the metering valve is opened, so that a certain amount of fuel continues to flow inside the control chamber to damp oscillation of the rod. Such flow, however, impairs the injector nozzle opening response of the rod, while at the same time circulating fuel to no purpose. Moreover, formation of the micrometric grooves is fairly expensive.

SUMMARY OF THE INVENTION

It is an object of the present invention to provide a highly straightforward, reliable device for controlling an injector of the above type, designed to eliminate the aforementioned drawbacks typically associated with known devices.

According to the present invention, there is provided a device for controlling an internal combustion engine fuel injector comprising a metering valve having a valve body with a guide seat for a rod controlling the injector, and a control chamber coaxial with said guide seat; said control chamber communicating with a discharge chamber via a discharge conduit; said rod comprising a stop portion which is arrested against an end surface of said guide seat to temporarily close said control chamber; and a pressurized-fuel inlet conduit communicating with a portion of said guide seat adjacent to said end surface; characterized in that said stop portion has a truncated-cone-shaped surface which engages a truncated-cone-shaped portion of said end surface; said truncated-cone-shaped portion being adjacent to said control chamber, and having an identical taper to that of said truncated-cone-shaped surface.

BRIEF DESCRIPTION OF THE DRAWINGS

A preferred, non-limiting embodiment of the present invention will be described by way of example with reference to the accompanying drawings, in which:

FIG. 1 shows a partial section of a fuel injector incorporating a control device in accordance with the present invention;

FIG. 2 shows a larger-scale portion of FIG. 1.

DETAILED DESCRIPTION OF THE INVENTION

Number 11 in FIG. 1 indicates as a whole a fuel injector, e.g. for an internal combustion engine, comprising a hollow body 12 supporting a nozzle 10 terminating at the bottom with one or more injection orifices. Body 12 comprises an axial cavity 13 in which slides loosely a control rod 14 connected to a pin 9 closing the injection orifice.

Body 12 also comprises an appendix 15 in which is inserted an inlet fitting 16 connected to a normal fuel supply pump for supplying fuel at very high pressure, e.g. 1350 bar; appendix 15 comprises a conduit 17 connecting fitting 16 to an injection chamber 8 of nozzle 10, located at a shoulder 7 of pin 9; and body 12 also comprises a substantially cylindrical cavity 18 with a thread 19, and a seat 21 separated from cavity 18 by a shoulder 23.

Injector 11 also comprises a metering valve, indicated as a whole by 24, which is housed inside seat 21, is controlled by the armature stem 25 of an electromagnet (not shown), and in turn comprises a valve body 26 having a flange 29, which is engaged by an externally threaded ring nut 31 screwed to thread 19 of cavity 18.

The gap between ring nut 31 and stem 25 forms a discharge chamber 32 of valve 24, which chamber 32 communicates in known manner with a discharge fitting 33 connected to the fuel tank, so that the fuel in chamber 32 is substantially at atmospheric pressure. Axial cavity 13 of hollow body 12 also communicates with discharge fitting 33, via a discharge conduit 34 formed in body 12, so that cavity 13 is also at atmospheric pressure.

Valve body 26 comprises an axial hole 36 defining a guide seat for a top portion 37 of rod 14; and a control chamber 38 (FIG. 2) coaxial with hole 36, which is connected to chamber 38 by an end surface indicated as a whole by 40.

Valve body 26 comprises an outer annular groove 39 communicating with an upper portion 45 of hole 36 via a calibrated conduit 41, which forms the inlet conduit of control chamber 38; and hollow body 12 comprises another conduit 42 connecting fitting 16 to annular groove 39, which therefore acts as a distribution chamber for distributing fuel from conduit 42 to control chamber 38.

Control chamber 38 comprises a calibrated discharge conduit 44 communicating with discharge chamber 32; and, to prevent fuel flowing from control chamber 38 to axial cavity 13, portion 37 of rod 14 is provided with two annular seals 47.

With the aid of a spring 46, the pressure on rod 14 of the fuel in chamber 38 and portion 45 of hole 36 is greater than the pressure of the fuel in chamber 8 on shoulder 7 of pin 9, so that rod 14 normally holds pin 9 down closing nozzle 10 of injector 11; and discharge conduit 44 of control chamber 38 is normally closed by a shutter in the form of a ball 48, which rests in a conical seat 50 and is guided by a guide plate 49 acted on by a flange 51 of armature stem 25.

According to the invention, top portion 37 of rod 14 comprises a stop portion 52 having a truncated-cone-shaped surface 53, which engages a truncated-cone-shaped portion 54 of end surface 40 of hole 36 to arrest the upward travel of rod 14. Truncated-cone-shaped portion 54 is adjacent to the bottom edge of control chamber 38, and has the same taper as truncated-cone-shaped surface 53 of stop portion 52.

The outside diameter of truncated-cone-shaped portion 54 is advantageously 1.1 to 1.5 times the diameter of control chamber 38 to minimize the contact area between surface 53 and portion 54; and the taper of surface 53 and portion 54 has an angle $\alpha$ at the vertex ranging from 120° to 150°.

Truncated-cone-shaped surface 53 forms an edge 56 with the lateral surface of top portion 37 of rod 14; portion 45 of hole 36 has a surface 57 larger in diameter than hole 36; and the height of surface 57 is so selected as to prevent edge 56 from contacting the surface of guide seat 36 of portion 37 throughout the travel of rod 14.

Injector 11 operates as follows.

When the electromagnet is energized, stem 25 of the armature is raised; the fuel pressure in control chamber 38 opens metering valve 24; the fuel pressure in injection chamber 8 overcomes spring 46 to raise both pin 9 and rod 14; and pin 9 opens nozzle 10 of injector 11, while the fuel in chamber 38 is discharged into the tank via chamber 32 and fitting 33.

When truncated-cone-shaped surface 53 of portion 52 of rod 14 engages truncated-cone-shaped portion 54 of surface 40, rod 14 is arrested, thus generating on portion 54 of surface 40 a reaction perpendicular to truncated-cone-shaped surface 53 and therefore directed towards the axis of rod 14. The component of the reaction parallel to the rod axis is therefore very small, thus reducing rebound of rod 14.

Moreover, by virtue of the small contact area between surface 53 and portion 54, the fuel pressure in portion 45 causes fuel to leak along portion 54 into control chamber 38, thus drawing rod 14 upwards to damp any residual rebound.

When the electromagnet is deenergized, a spring (not shown) lowers stem 25 and pushes ball 48 against conical seat 50 to close valve 24; and the fuel pressure inside control chamber 38 now increases rapidly to lower rod 14 together with pin 9, which closes nozzle 10 of injector 11.

The advantages, as compared with known devices, of the control device according to the invention will be clear from the foregoing description. In particular, control rod 14 closes chamber 38 extremely rapidly, so that fuel supply by injector 11 is steadier than that of known injectors. Moreover, the fuel leakage along portion 54 of surface 40 is less than in the case of a grooved rod stop surface. And finally, no high-cost machining is required to groove the rod stop surface.

Clearly, changes may be made to the control device as described and illustrated herein without, however, departing from the scope of the accompanying claims. For example, inlet conduit 41 may be inclined as opposed to radial; edge 56 may be rounded; and surface 57 of portion 45 may have the same diameter as hole 36.

I claim:

1. A device for controlling an internal combustion engine fuel injector (11) comprising a metering valve (24) having a valve body (26) with a guide seat (36) for a rod (14) controlling the injector, and a control chamber (38) coaxial with said guide seat (36); said control chamber (38) communicating with a discharge chamber (32) via a discharge conduit (44); said rod (14) comprising a stop portion (52) which is arrested against an end surface (40) of said guide seat (36) to temporarily close said control chamber (38); and a pressurized-fuel inlet conduit (41) communicating with a portion (45) of said guide seat (36) adjacent to said end surface (40); characterized in that said stop portion (52) has a truncated-cone-shaped surface (53) which engages a truncated-cone-shaped portion (54) of said end surface (40); said truncated-cone-shaped portion (54) being adjacent to said control chamber (38), and having an identical taper to that of said truncated-cone-shaped surface (53).

2. A device as claimed in claim 1, characterized in that said truncated-cone-shaped portion (54) has an outside diameter of 1.1 to 1.5 times the diameter of said control chamber (38).

3. A device as claimed in claim 1, characterized in that said taper has an angle ($\alpha$) at the vertex ranging from 120° to 150°.

4. A device as claimed in claim 1, wherein said truncated-cone-shaped surface (53) terminates in an edge (56) intersecting the lateral surface of said rod (14); characterized in that said portion (45) of said guide seat (36) comprises a surface (57) larger in diameter than said guide seat (36) to prevent said edge (56) from contacting said guide seat (36).

* * * * *